US006297737B1

(12) United States Patent
Irvin

(10) Patent No.: US 6,297,737 B1
(45) Date of Patent: Oct. 2, 2001

(54) OBJECT LOCATING SYSTEM

(75) Inventor: David R. Irvin, Raleigh, NC (US)

(73) Assignee: Ericsson INC, Research Triangle Park, NC (US)

( * ) Notice: Subject to any disclaimer, the term of this patent is extended or adjusted under 35 U.S.C. 154(b) by 0 days.

(21) Appl. No.: 09/541,200

(22) Filed: Apr. 3, 2000

(51) Int. Cl.[7] ..... G08B 13/14

(52) U.S. Cl. ..... 340/571; 340/539; 340/572.1; 340/825.08; 340/825.49

(58) Field of Search ..... 340/572.1, 571, 340/568.1, 505, 539, 573.1, 573.4, 825.08, 10.1, 825.49

(56) References Cited

U.S. PATENT DOCUMENTS

| | | | | |
|---|---|---|---|---|
| 4,918,425 | * | 4/1990 | Greenberg et al. | 340/539 |
| 5,673,023 | * | 9/1997 | Smith | 340/571 |
| 5,680,105 | | 10/1997 | Hedrick | 340/571 |
| 5,939,981 | * | 8/1999 | Renney | 340/539 |
| 6,084,517 | * | 7/2000 | Rabanne et al. | 340/573.4 |
| 6,133,832 | * | 10/2000 | Winder et al. | 340/572.1 |

OTHER PUBLICATIONS

Article entitled "Bluetooth—The Universal Radio Interface for Ad Hoc, Wireless Connectivity" from No. 3, 1998 edition of Ericsson Review journal (8 pages).

* cited by examiner

*Primary Examiner*—Thomas Mullen
(74) *Attorney, Agent, or Firm*—Coats & Bennett

(57) ABSTRACT

A locating unit includes a wireless communications interface for transmitting signals to one or more locating tags. A user physically associates each tag with an item of interest, such as a briefcase or key ring. When a tagged item is misplaced, the user uses the locating unit to find it. Using the user interface included in the locating unit, the user selects the desired item from a listing of tagged items. Based on the user selection, the locating unit polls the associated tag. The polled tag responds by emitting an audible signal, thereby aiding the user in determining its location. Preferably, the locating unit is a mobile terminal and communications between the mobile terminal and individual tags is two-way. Thus, a polled tag returns a found signal to the mobile terminal in response to being polled. The mobile terminal provides the user with found/not-found indication, from which the user can ascertain whether the desired tagged item is within range of the polling signal, even if the tag's audible signal cannot be heard. Tags preferably include a switch that, when actuated, causes the tag to poll the mobile terminal. In response to receiving a poll signal from a tag, the mobile terminal emits an audible signal and returns a found signal to the polling tag. The polling tag provides the user with a found/not-found indicator. Thus, individual tags can be used to locate the mobile terminal. Preferably, the wireless interfaces in the mobile terminal and locating tags are Bluetooth transceivers.

27 Claims, 6 Drawing Sheets

OBJECT LOCATING SYSTEM

BACKGROUND OF THE INVENTION

The present invention relates to a wireless system for conveniently determining the whereabouts of one or more objects and, particularly, to using a mobile terminal, such as a cellular telephone, in such a system.

Remembering the current location of everyday items is challenging, particularly for active people with busy schedules. Being able to quickly locate a purse, briefcase, or set of car keys, may be the difference between being late or on time for an important meeting. Further, it is simply less frustrating when forgotten or misplaced items are easily located.

Various types of systems facilitate determining the location of one or more misplaced items. In particular, various wireless systems include a transmitter unit and a corresponding set of one or more receiving units. Typically, these receiving units have a physical configuration that allows for their convenient attachment to various items of interest. As noted above, such items might include handbags, briefcases, or car keys. In existing schemes, the transmitter unit emits a signal to which one or more receiving units are responsive. Upon receiving the signal from the transmitter unit, a receiving unit emits an audible signal, thereby enabling a person to more easily locate the particular item to which the receiving unit is attached.

While functional, these existing systems have distinct shortcomings. As the basic problem these systems try to solve is largely one of being able to quickly locate various items of interest, adding a transmitting unit to that list of items is counterproductive. Simply, the utility of the transmitting unit lies only in its ability to aid in locating various receiving units attached to various items of interest. Users are therefore forced to remember the location of a device whose only purpose is to help locate other devices. Ironically, users may spend as much time searching for the transmitting unit as might have been expended in an unaided search for the item of interest.

Restricted functionality represents another shortcoming of these existing systems. For example, the transmitting unit sends a one-way signal to one or more of the receiving units and the receiving units simply beep in response. If the receiving unit attached to the item of interest is covered or enclosed by another object, its audible signal may not be noticeable to the searcher. Thus, absent this feedback, the searcher has no indication that the item of interest is even in the searcher's general vicinity and is apt to needlessly extend the search into areas well removed from the item's actual location. Worse, the searcher may erroneously conclude that the item of interest is somewhere else entirely and prematurely end their search.

Another shortcoming of existing systems is the inability to conveniently manage the tracking of multiple objects. Ideally, the transmitting unit would provide the searcher with a convenient interface allowing the searcher to view listings of the various items that have been associated with corresponding receiving units. From this listing, the searcher would be able to pick one or more items and, based on the selected items, the transmitting unit would cause the corresponding receiver units to beep. In general, providing such an interface is impractical because of the expense added to a transmitting unit that, apart from its locating capabilities, provides no value or functionality to a user.

Accordingly, there remains a need for an object locating system that provides users with an indication that a receiving unit physically associated with an item of interest is nearby, even if the audible signal from the receiving unit is somehow muffled or attenuated below the threshold of hearing. Preferably, the object locating system includes a convenient user interface providing straightforward selection of the desired objects, such that the transmitting unit specifically stimulates the receiving units corresponding to the desired objects. Ideally, the object locating system includes a transmitting unit that serves other useful functions.

SUMMARY OF THE INVENTION

The present invention includes both methods and apparatus for allowing a user to conveniently determine the location of one or more items of interest. A primary device having some form of user interface includes a wireless communications interface adapted to communicate with one or more separate tags, each tag having a compatible wireless communications interface. The user attaches a tag to each item of interest. The tags may assume various physical configurations, such as literal tags for convenient attachment to briefcases and the like, or such as fobs for convenient attachment to key rings and the like. Preferably, the primary device is a mobile terminal, such as a cellular telephone, and includes a Bluetooth wireless transceiver for communicating with the tags. In turn, the tags include corresponding, compatible Bluetooth interfaces. In this preferred embodiment, the mobile terminal and tags together form a Bluetooth piconet, with the tags functioning as slaves in the piconet.

To determine the location of a particular item, the user identifies the desired item using the mobile terminal interface. The mobile terminal might, for example, display a menu that lists all tags and their corresponding items. After the user picks the desired item, the mobile terminal emits a polling signal via its Bluetooth interface. Information in the polling signal allows the tag corresponding to the desired item to determine that the poll is directed to it. Upon receipt of this polling signal, the tag emits a loud beep or other acoustic signal. By homing in on the audible signal, the user is able to locate the tag and its corresponding item of interest. Additionally, the polled tag returns an acknowledgment to the mobile terminal, allowing the mobile terminal to convey a found message or signal to the user. This found signal enables the mobile terminal to affirm to the user that the desired item is within range of the polling signal, and is particularly meaningful if the acoustic signal from the polled tag is muffled or otherwise attenuated.

Preferably, the tags themselves include a poll switch that, when actuated by the user, allows an individual tag to poll the mobile terminal. In this manner, any tag may be used to assist the user in locating the mobile terminal. In response to receiving a locator poll from a tag, the mobile terminal emits an acoustic signal, thereby allowing the user to conveniently locate it. Additionally, the mobile terminal returns a found signal to the polling tag, allowing the polling tag to convey a found indicator to the user. Ideally, the polling tags include a visual indicator, such as an LED, to indicate the found response. Optionally, the tags may indicate the found response via acoustic signaling.

DETAILED DESCRIPTION OF THE INVENTION

Figure 1:
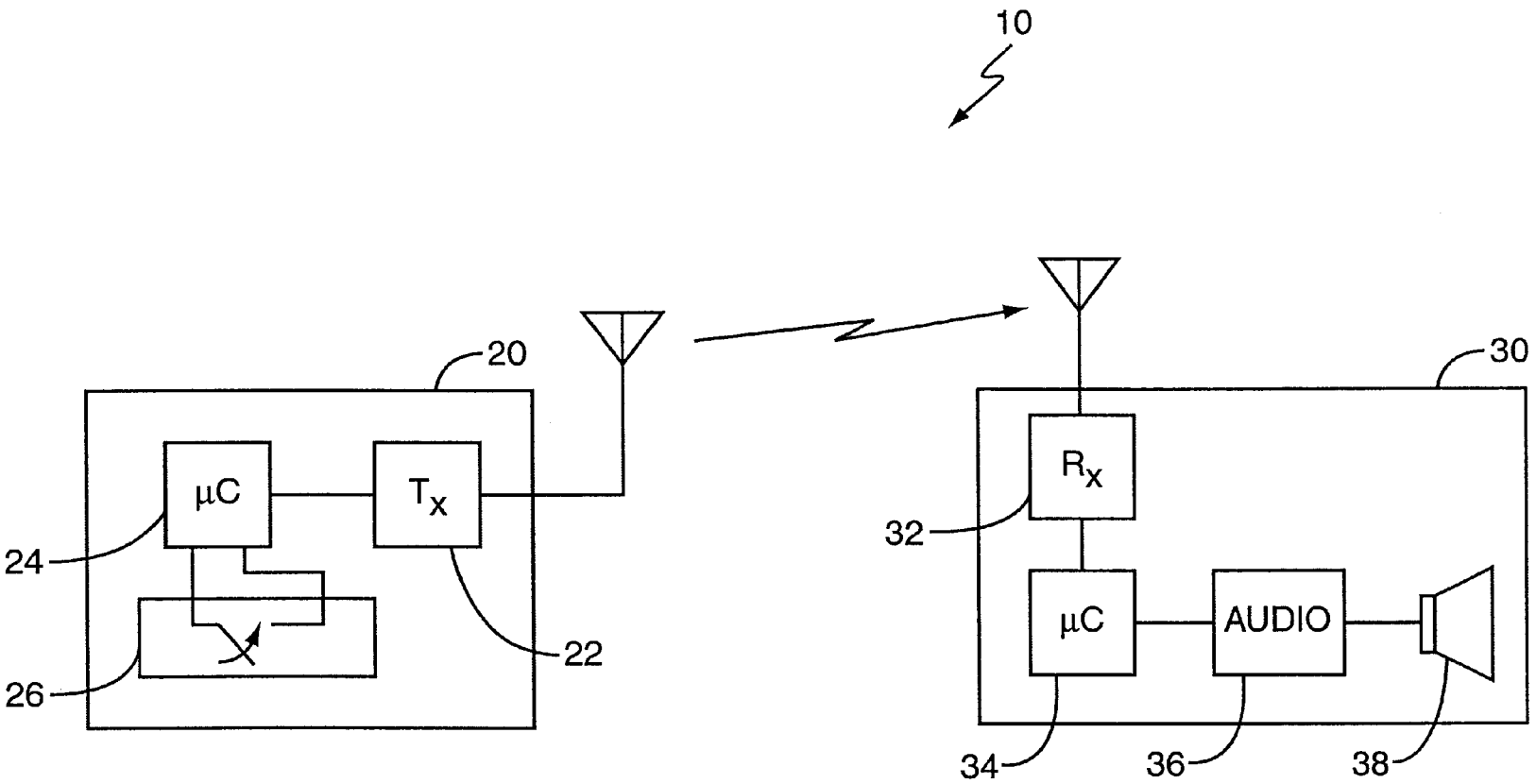
FIG. 1 PRIOR ART
FIG. 1 is a simplified block diagram of a prior art object locating system.

FIG. 1 presents a simplified diagram illustrating a typical prior art locating system 10, including a transmitter 20 and a corresponding receiver 30. Such prior art locating systems typically include only one or two such receivers 30. Thus, the limited number of receivers 30 limits the number of items of interest that may be tracked using prior art locating systems 10. A simple microprocessor 24 combines with a transmitting circuit 22 to form the core of transmitter 20. Transmitter 20 additionally includes an activation switch 26 that, when actuated by the user, causes the transmitter 20 to transmit a signal. Receiver 30 receives this signal via a receiving circuit 32 and processes the received signal using a simple microprocessor 34. In response to receiving the signal, the receiver outputs an audible tone or beep using audio output circuit 36 and associated transducer 38 (e.g., speaker).

Typically, receiver 30 may provide this audio signal until a subsequent signal is received from the transmitter 20, or may output the audio signal for a defined interval of time. The signal transmitted by the transmitter 20 usually has fixed or predefined characteristics, and the microprocessor 34 in the receiver 30 is preprogrammed to respond only to received signals matching these predefined characteristics. Various embodiments exist for receiver 30, including tags or cards suitable for tethering to briefcases, handbags, and other such articles. Alternately, receiver 30 may be housed within a fob for attachment to a key ring. For the locating system 10 to be useful, a user attaches receiver 30 to an item of interest. Whenever the item is misplaced, the user polls receiver 30 using transmitter 20 and then homes in on the resultant audio signal, to locate the item.

Figure 2:
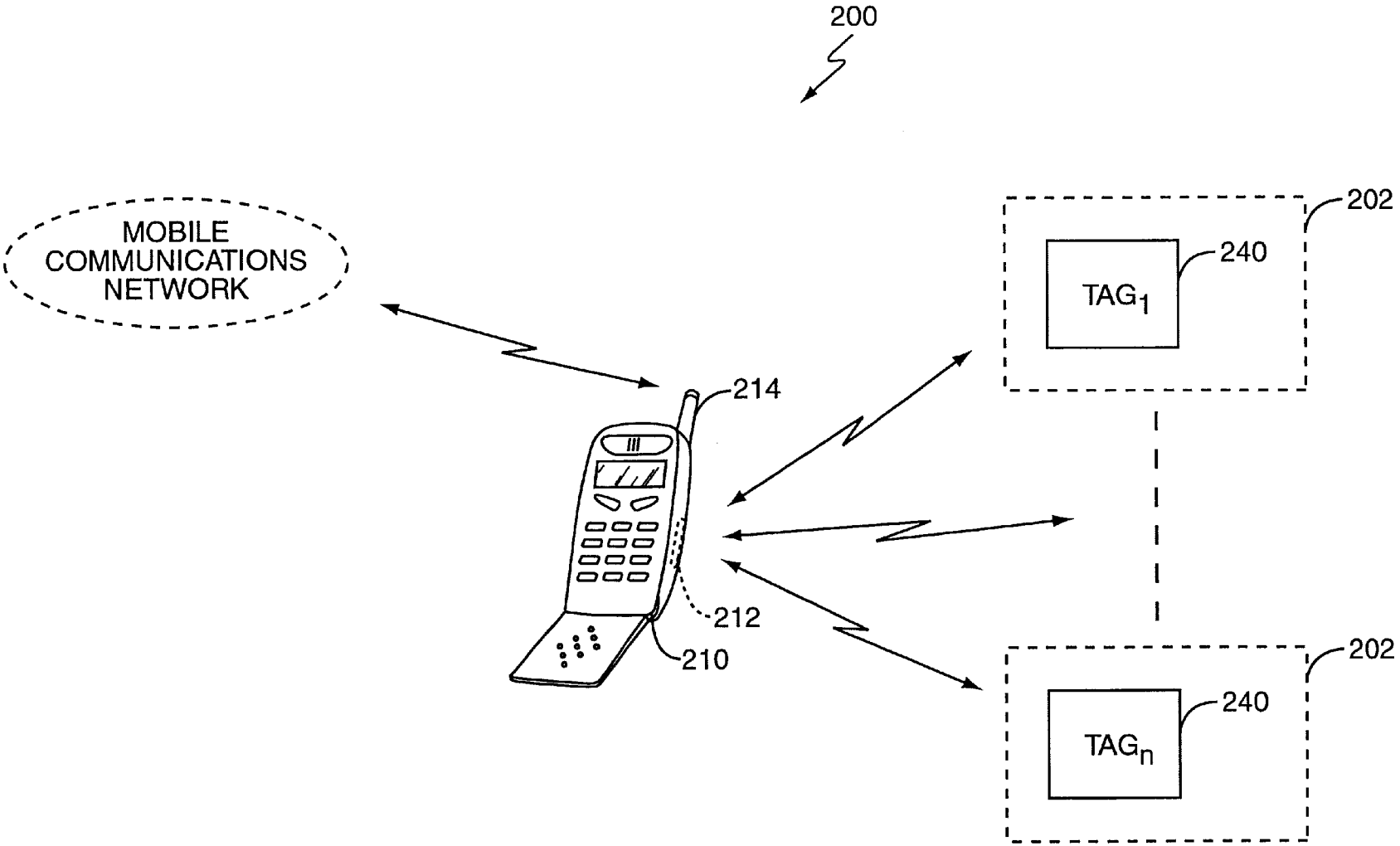
FIG. 2 is a simplified block diagram of an object locating system in accordance with an exemplary embodiment of the present invention.

FIG. 2 illustrates an exemplary embodiment of the present invention. In the locating system 200, a mobile terminal 210 serves as a primary locating device, capable of communicating with one or more tags 240. Using the mobile terminal 210 in this manner provides a user with significant advantages. These advantages include access to tag locating functions using a full-featured user interface available in the typical mobile terminal 210. Conventional mobile terminals include keypads or equivalent input devices, text and/or graphic display devices, and full audio input/output capabilities. Because mobile terminals represent an item of everyday use for many people, using a mobile terminal 210 as a device to locate other items is particularly convenient.

In general use, a user physically associates one or more tags 240 with various items of interest 202. The mobile terminal 210 includes a wireless communications interface adapted for communicating with the tags 240. Note that the tag-locating wireless communications interface in the mobile terminal 210 may be independent of the primary base station or satellite communications interface. In an exemplary embodiment, the object-locating wireless interface is a Bluetooth transceiver. Other exemplary embodiments use other wireless communication interfaces. Thus, under user control, signals transmitted from the mobile terminal 210 cause selected ones of the tags 240 to emit an audible signal. Using this audible signal, the user can conveniently locate the items 202 to which the tags 240 are attached. Although consistently referred to as "tags," the tags 240 may have several different physical configurations, with each different physical configuration better suited for attachment to or inclusion within a particular type of item. Thus, the tags 240 may include key ring fobs, luggage tags, and other configurations.

Figure 3:
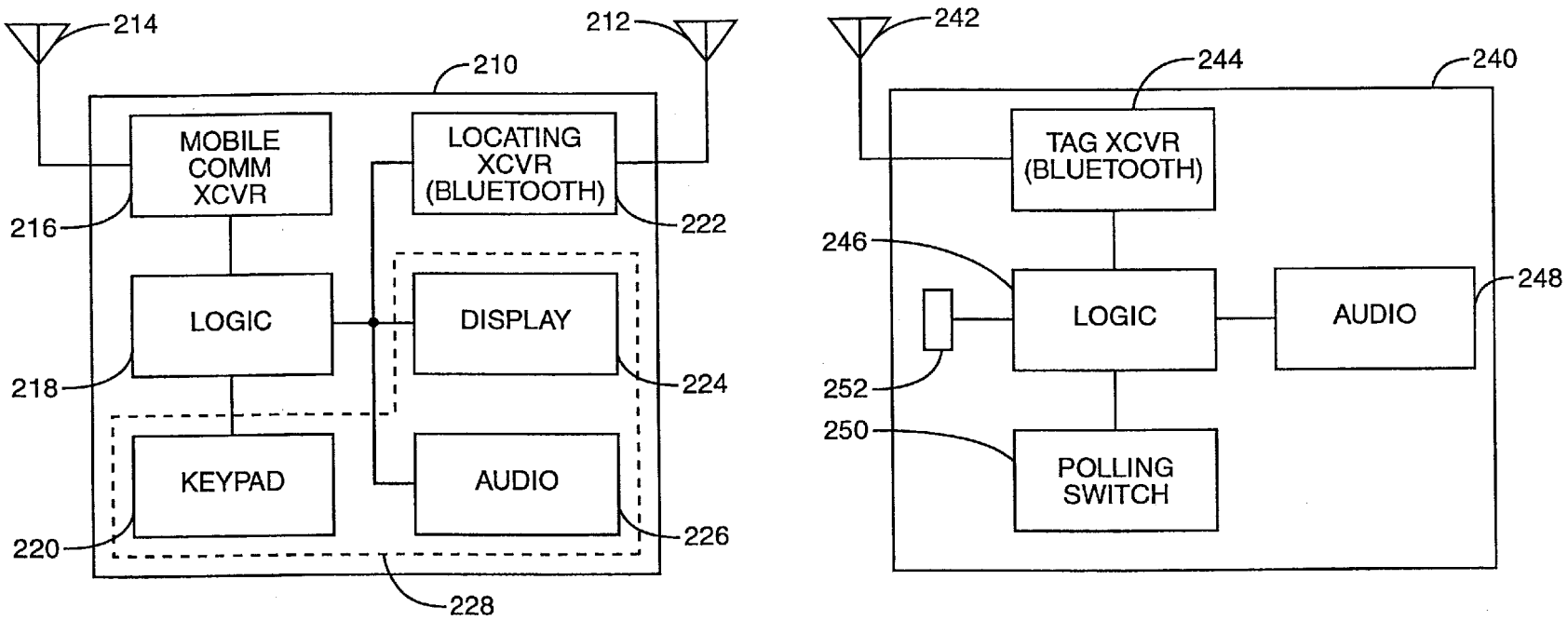
FIG. 3 is a more detailed block diagram of the mobile terminal and corresponding tags of FIG. 2.

FIG. 3 provides more details regarding the design of the enhanced mobile terminal 210 and a corresponding tag 240, in accordance with an exemplary embodiment of the present invention. Mobile terminal 210 comprises a cellular antenna 214 and associated cellular transceiver 216, a logic unit 218, keypad 220, display 224, and audio output circuit 226. An exemplary audio output circuit 226 includes a tone generator and output speaker. The keypad 220, display 224, and audio output circuit 226 combine to form user interface 228. While the foregoing elements are representative of a conventional mobile terminal 210, any given mobile terminal 210 may implement variations or provide similar functionality with different elements.

For example, the mobile terminal 210 may consolidate keypad and display functions in a touch-screen (not shown). Regardless of how it is implemented, it is advantageous for the mobile terminal 210 to include some form of user interface, basic logic processing, and audio output. To these basic capabilities, an exemplary embodiment of the present invention adds a wireless transceiver 222 and associated antenna 212. The added wireless transceiver 222 allows the mobile terminal 210 to communicate with one or more tags 240. As the mobile terminal 210 already includes a full-featured user interface 228, the incremental cost of adding a local wireless interface for object locating purposes is not significant.

As noted, tags 240 may take on various physical configurations. Regardless of physical configuration, the tag 240 in an exemplary embodiment includes an antenna 242 and associated wireless transceiver 244, a logic unit 246, an audio output circuit 248, a polling switch 250, and, optionally, a visual indicator 252. In basic operation, the tag 240 receives a poll or locate signal from the mobile terminal 210. In response to the poll, the tag 240 emits an audible signal using audio output circuit 248. Optionally, the tag 240 additionally provides a visible signal using the visual indicator 252—preferably a visible LED. The tag 240 may continue emitting the audible signal for a defined period of time, or may continue its audible signal until a subsequent signal is received from the mobile terminal 210. As a further option, the tag 240 may continue emitting its audible signal until the user actuates its polling switch 250 or at the end of a defined time interval, whichever occurs first.

In an exemplary embodiment of the present invention, the wireless transceiver 222 in the mobile terminal 210 and corresponding wireless transceiver 244 in tags 240 are compatible, if not identical, Bluetooth transceivers. Basing the communications interface between the mobile terminal 210 and the tags 240 on the Bluetooth standard represents an exemplary embodiment of the present invention, but other, alternative wireless communication interfaces may be used to provide similar object locating capability. In these alternative embodiments, the communications between the mobile terminal 210 and tags 240 may be one-way or two-way, with the specific implementation representing a balance of features, price, and power consumption. However, using the Bluetooth standard imparts advantages to some exemplary embodiments of the present invention. Many of these advantages stem from the adoption of Bluetooth technology as an enabling feature for many expanded mobile terminal functions. Thus, the Bluetooth interface may be included in the mobile terminal 210 as common practice and the present invention makes advantageous use of this interface.

Bluetooth defines a universal radio interface in the 2.45 GHz Industrial-Scientific-Medical (ISM) frequency band. Specific portions of this bandwidth are available on an essentially global basis. Thus, Bluetooth-capable systems can operate internationally. Bluetooth permits disparate electronic devices or systems to communicate with each other via short-range communications. A group of two or more devices in local communications with each other using Bluetooth form a Bluetooth network, referred to as a piconet. A piconet comprises up to eight Bluetooth devices, with one device serving as the master and the remaining devices acting as slaves in the piconet. A given Bluetooth device in a given piconet may alternately participate in other piconets, with a group of piconets referred to as a scatternet.

While those skilled in the art may understand and practice the present invention absent detailed presentation of Bluetooth specifications, the papers "*Bluetooth—The universal radio interface for ad hoc, wireless connectivity,*" by Jaap Haartsen, Ericsson Review No. 3, 1998, pp. 110–117, and "*Ericsson's Bluetooth Modules,*" by Arfwedson and Sneddon, Ericsson Review No. 4, 1999, pp. 198–205, provide substantial detail regarding the implementation and operation of Bluetooth transceivers and are incorporated herein by reference. Additional Bluetooth technical specifications may be obtained by accessing a Bluetooth Special-Interest-Group (SIG) website at http://www.bluetooth.com.

Figure 4:
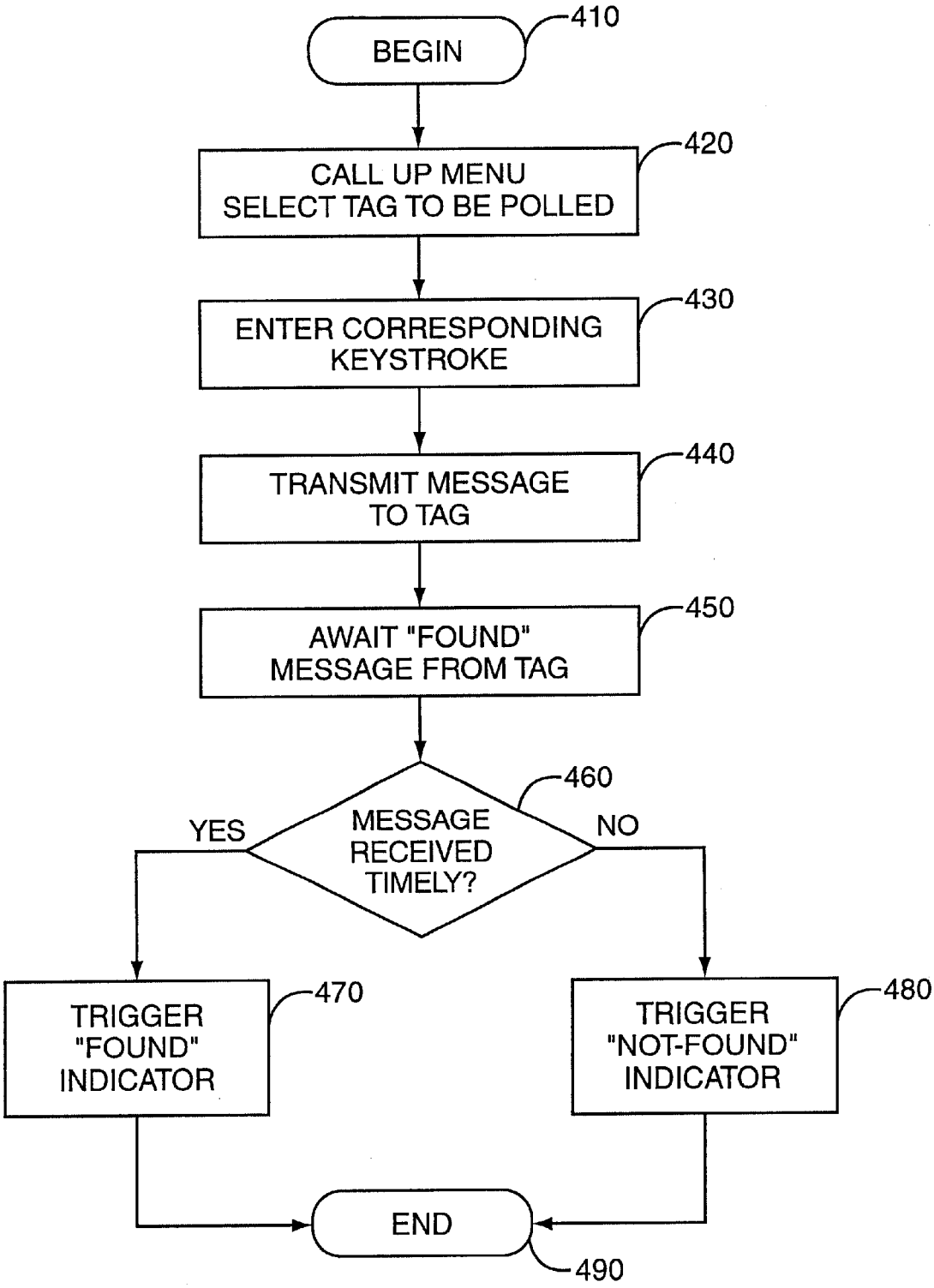
FIG. 4 is a simplified flow diagram illustrating two-way communications operating logic for a locating unit in accordance with an exemplary embodiment of the present invention.

FIG. 4 generally illustrates the operating logic for a locating unit having bi-directional communication capability with one or more tags 240. Preferably, the locating unit is mobile terminal 210 in accordance with an exemplary embodiment of the present invention. Operation begins (block 410) with the user activating a menu on the display 224 of the mobile terminal 210 (block 420). The menu may be activated through the user entering a defined key sequence, and may represent a selection choice presented to the user in other available menus. The operating or controlling program of the mobile terminal 210 preferably allows the user to enter descriptive names corresponding to the various items with which the individual tags 240 are physically associated. For example, a user may associate a first tag 240 with a set of car keys, a second tag 240 with a briefcase, and a third tag with a personal organizer or address book. Thus, the mobile terminal 210 associates convenient item names with specific tags.

When the user wishes to find a specific misplaced item, the user activates the item menu or listing by keying in a sequence of keystrokes or performing another programmed action. The menu presents the user with a convenient listing representative of the various items of interest, one or more of which may be misplaced by the user. The user enters keystrokes via keypad 220 corresponding to a specific misplaced item (block 430). In response to the user input, the mobile terminal 210 transmits a poll message (block 440). All tags 240 within reception range of the poll signal receive the poll. However, the mobile terminal 210 can individually address each tag 240 by including identifying information in the transmitted poll signal. By including identifying information in the poll signal, the mobile terminal 210 directs the poll to a specific tag 240, termed the "polled" tag. Each tag 240 has a defined tag identifier and the mobile terminal 210 includes one of these defined tag identifiers in a given poll signal. The tags 240 process the poll signal to recover the identifying information. The tag 240 corresponding to the identifying information included in the poll signal by the mobile terminal 210 responds to the poll signal by emitting an audible signal.

Preferably, the audible signal is a repeating, intermittent signal. An intermittent signal uses less power than a continuous tone, yet provides the user with a persistent sound source for convenient tag locating. Polled tags 240 may emit the audible signal after activation by a directed poll signal based on a programmed time interval, may continue emitting the audible signal until the user deactivates the tag after finding it, or may continue emitting the audible signal until receiving a subsequent poll or message from the mobile terminal 210.

Capitalizing on the two-way facilities of the Bluetooth interface, the mobile terminal 210 transmits the poll signal (block 440) and then waits on a found signal (block 450). In response to being polled, the specific tag 240 to which the poll signal was directed transmits a return signal to the mobile terminal 210. In an exemplary embodiment, this return signal is a found message. Because the found message includes identifying information associated with the polled tag 240, the mobile terminal 210 determines if the message is from the appropriate tag 240—the tag 240 most recently polled by the mobile terminal 210.

If the found message is received from the polled tag 240 within a predefined interval of time (block 460), the mobile terminal 210 provides the user with a "found" indicator (block 470), alerting the user that the polled tag 240 is within polling range. Such indication may be an audible signal, a message on the mobile terminal display 224, or another visual indicator. In any case, the indication is particularly helpful to users attempting to find an item associated with the polled tag 240, when the audible signal from the tag 240 is somehow muffled or attenuated. If the message is not timely received (block 460), the mobile terminal 210 provides the user with a "not found" indicator (block 480), alerting the user that the polled tag 240 is either out of polling range or is otherwise unresponsive. The exemplary locating functions end (block 490) after the found/not found processing.

Figure 5:
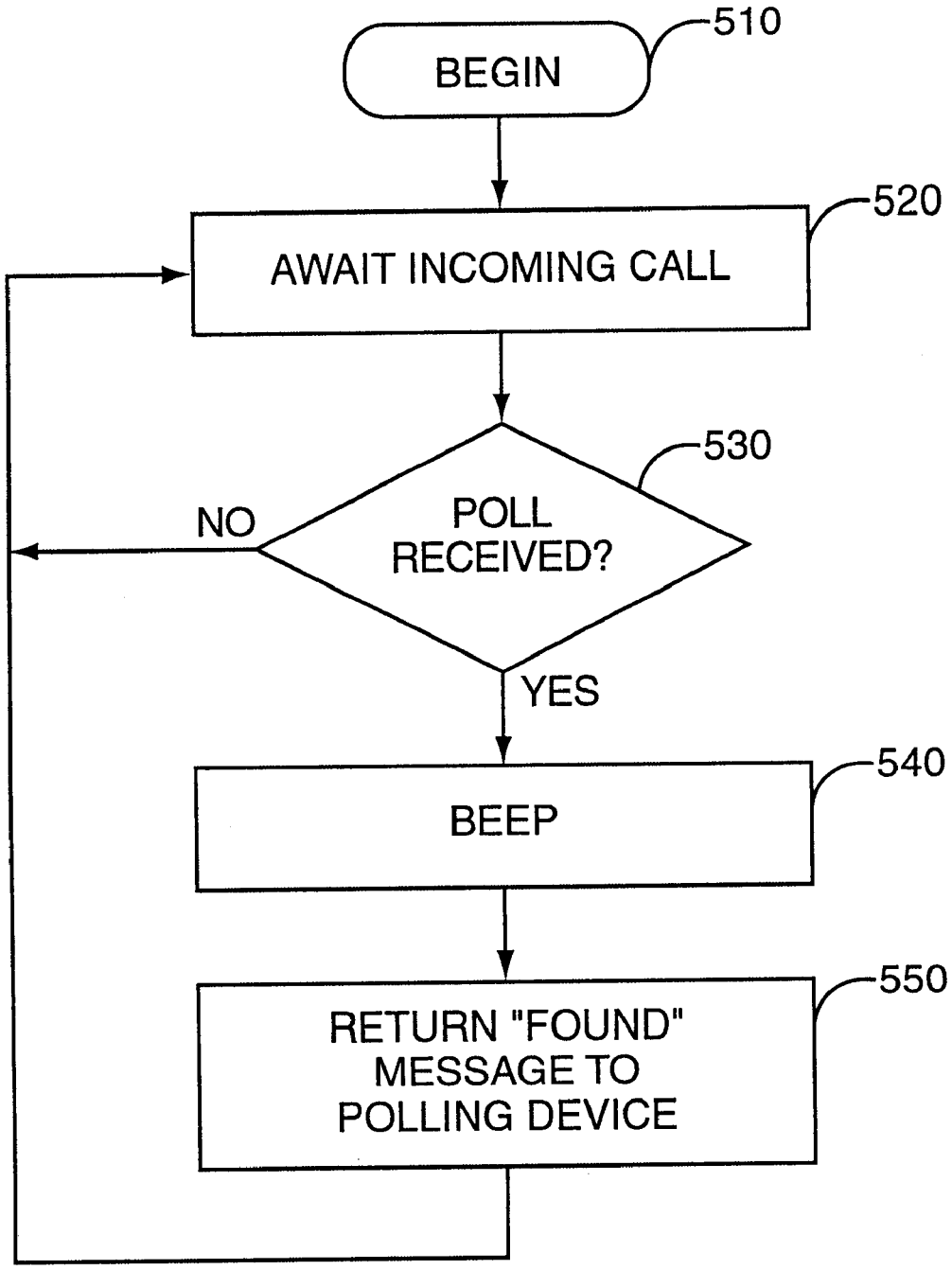
FIG. 5 is a simplified flow diagram illustrating the operation of a "polled" tag in accordance with an exemplary embodiment of the present invention.

FIG. 5 illustrates exemplary operation of a "polled" device within the system 200 of the present invention. As an additional convenience feature in an exemplary embodiment of the present invention, either the tags 240 or the mobile terminal 210 may be the "polled" device. First, from the perspective of a tag 240, operation begins (block 510) in essentially a wait or standby state where the tag 240 simply awaits an incoming poll (block 520). Preferably, the tags 240 are designed to consume minimal power in this standby state, thus increasing battery life. When the tag 240 receives a poll signal, it processes the poll to determine if the poll is directed to it (block 530). If the poll is not directed to the individual tag 240, it returns to the standby or waiting state (block 520). However, if the poll signal is directed to the tag 240 (block 530), the tag 240 activates its audible signal (block 540) and transmits a found signal (block 550) back to the polling device (in this case, the mobile terminal 210).

As a further convenience in an exemplary embodiment of the present invention, any tag 240 may be used to locate the mobile terminal 210. The tags 240 preferably include a polling switch 250 or other mechanism that, when actuated by the user, causes the tag 240 to transmit a poll signal to the mobile terminal 210. Thus, FIG. 5 may also be viewed from the perspective of the mobile terminal 210. In this case, a user uses any one of the tags 240 to poll the mobile terminal 210 when the mobile terminal itself is misplaced but the user is in possession of at least one object and its corresponding tag 240.

In this scenario, operation begins (block 510) with the mobile terminal 210 waiting on an incoming poll signal (block 520). Note that, because of its sophistication, the mobile terminal 210 preferably executes the logic of FIG. 5 concurrent with other mobile terminal tasks and, thus, the mobile terminal 210 is available for other user operations in addition to being responsive to incoming polls from the tags 240. When a poll is received from a given tag 240 (block 530), the mobile terminal 210 responds by activating an audible signal that allows the user to determine the unknown location of the mobile terminal 210 (block 540). All tags 240 direct their polling signal or message to the mobile terminal 210. The polling signal from the tags 240 also includes information identifying the specific tag 240 that polled the mobile terminal 210.

Thus, the mobile terminal 210 can return a "found" message to the polling tag 240 (block 550). In response to receiving the found message from the mobile terminal 210, the polling tag 240 provides an indicator to the user. Preferably, the indicator is a visible indicator output on the visible indicator 252 of the tag 240. Alternately, or in addition to the visible indicator, the tag 240 may provide the user with an audio signal in response to receiving the found signal from the mobile terminal 210. Preferably, this audio signal is distinct from the audio signal emitted by the tag 240 in response to it receiving a poll signal from the mobile terminal 210.

While some exemplary embodiments of the present invention define a mobile terminal 210 in two-way, Bluetooth-based communications with a plurality of tags 240, other embodiments are contemplated. Communications between the mobile terminal 210 and the tags 240 need not be based on Bluetooth transceivers. Indeed, in certain applications, cost and/or power constraints may favor simpler, possibly proprietary, wireless interfaces. Further, as noted earlier, the communications need not be two-way. Additional design simplification and cost reductions are available in alternate embodiments of the present invention that provide only one-way communications between the mobile terminal 210 and tags 240.

Figure 6:
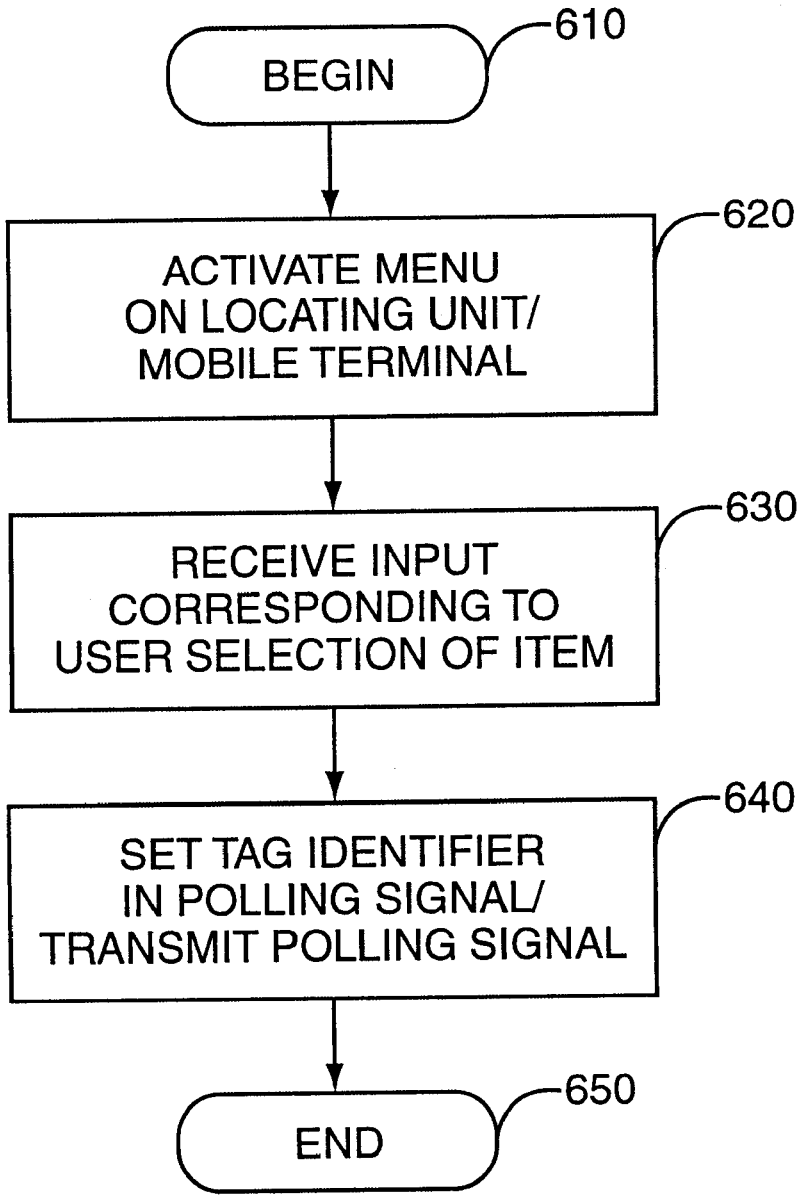
FIG. 6 is a simplified flow diagram illustrating the operation of one-way locating functions using a mobile terminal in accordance with an exemplary embodiment of the present invention.

FIG. 6 illustrates the logic for one-way operation in an exemplary embodiment of the present invention. Here, the mobile terminal 210 includes a one-way wireless transmitter. Operation begins (block 610) with the user activating the object-listing menu on the mobile terminal 210 (block 620). From the available choices, the user enters a keystroke or keystrokes corresponding to the desired misplaced item (block 630). Based on the selected item, the mobile terminal 210 transmits the poll signal (block 640), with the poll signal including identifying information corresponding to the associated tag 240. Logical operation ends (block 650), and the mobile terminal 210 continues other processing tasks.

Those skilled in the art will also appreciate that the present invention admits tremendous flexibility in implementation. Thus, operation, as illustrated in FIGS. 4–6, is not limiting. The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A locating system for locating objects, said system comprising:

a locating unit comprising a first radio transceiver to send a first polling signal and receive a first acknowledgement signal, said first radio transceiver also to receive a second polling signal and send a second acknowledgement signal in response thereto; and one or more tags attachable to items to be located, each tag having an associated tag identifier, each of said one or more tags comprising:

a second radio transceiver for receiving said first polling signal from said locating unit, said first polling signal comprising a tag identifier for a polled tag, and for selectively transmitting said first acknowledgment signal to said locating unit based on said tag identifier, said second radio transceiver also for receiving said second acknowledgement signal from said locating unit;

an audible tone generator for generating an audible signal in response to said first polling signal;

a polling switch that, when actuated, causes said tag to transmit said second polling signal comprising said tag identifier to said locating unit via said second radio transceiver; and an indicator for indicating receipt of said second acknowledgement signal from said locating unit.

2. The locating system of claim 1 wherein said locating unit further comprises a memory for storing a list of items to be located and associated tag identifiers.

3. The locating system of claim 2 wherein said locating unit further comprises a user interface including a display for displaying said list of items to be located to a user of said locating unit, and an input device for selecting an item to be located by said user, wherein said locating unit transmits a polling signal containing the tag identifier for the associated tag corresponding to the selected item.

4. The locating system of claim 1 wherein said locating unit provides an audible signal in response to receiving said second polling signal from said tag.

5. The locating system of claim 1 wherein said indicator in said tag comprises a visible indicator.

6. The locating system of claim 1 wherein said locating unit further comprises an indicator for indicating receipt of said first acknowledgement signal from said polled tag.

7. The locating system of claim 6 wherein said indicator in said locating unit comprises a display.

8. The locating system of claim 6 wherein said indicator in said locating unit comprises a tone generator.

9. The locating system of claim 6 wherein said indicator in said locating unit comprises an LED.

10. A locating device for locating objects, said locating device comprising:

a tag attachable to items to be located, said tag having an associated tag identifier;

a radio transceiver disposed on said tag for receiving a polling signal containing said tag identifier from a locating unit and for transmitting a signal to said locating unit;

an audible tone generator for generating an audible signal in response to said polling signal;

a polling switch for causing said radio transceiver to transmit a polling signal to said locating unit when said polling switch is actuated by a user; and an indicator for indicating receipt of an acknowledgement signal transmitted by said locating unit in response to said locating unit receiving said polling signal transmitted by said radio transceiver.

11. The locating device of claim 10 wherein said radio transceiver transmits an acknowledgement signal to said locating unit in response to said polling signal.

12. The locating device of claim 10 wherein said indicator is a visible indicator.

13. The locating device of claim 10 wherein said indicator is an audible indicator.

14. A method for locating an item having a polling tag associated therewith, said method comprising:

broadcasting a polling signal from a locating unit to said tag;

receiving said polling signal at said tag;

emitting an audible signal from said tag in response to said polling signal;

sending an acknowledgement from said tag to said locating unit in response to said polling signal;

receiving said acknowledgement at said locating unit;

indicating receipt of said acknowledgement at said locating unit;

transmitting a polling signal from said tag to said locating unit;

receiving said polling signal at said locating unit;

emitting an audible tone from said locating unit in response to said polling signal;

sending an acknowledgement signal from said locating unit to said tag in response to said receiving said polling signal; and indicating receipt of said acknowledgement signal from said locating unit at said tag.

15. The method of claim 14 wherein said polling signal contains a tag identifier that identifies said tag, and wherein said tag responds to polling signals containing a tag identifier associated with said tag.

16. The method of claim 14 wherein indicating receipt of said acknowledgement comprises displaying a message on a display.

17. The method of claim 14 wherein indicating receipt of said acknowledgement comprises generating an audible tone.

18. The method of claim 14 wherein indicating receipt of said acknowledgement comprises energizing an LED.

19. The method of claim 14 wherein indicating receipt of said acknowledgement signal from said locating unit at said tag comprises generating an audible signal at said tag.

20. The method of claim 14 wherein indicating receipt of said acknowledgement signal from said locating unit at said tag comprises generating a visible signal.

21. A method for locating objects using a mobile terminal, said method comprising:

displaying a listing of objects on a display in said mobile terminal, each of said objects having a locating tag associated therewith, each tag including an associated tag identifier;

selecting a desired object from said listing;

transmitting a polling signal to said locating tags, said polling signal including a tag identifier of said locating tag corresponding to said desired object;

emitting an audible signal selectively by said locating tag associated with said desired object based on said tag identifier in said polling signal;

transmitting a polling signal from any one of said locating tags to said mobile terminal;

receiving at said mobile terminal said polling signal from said any one of said locating tags;

emitting at said mobile terminal an audible signal in response to said polling signal from said any one of said locating tags;

determining a location of said mobile terminal based on said audible signal; and transmitting an acknowledgement signal from said mobile terminal to said any one of said locating tags in response to said polling signal.

22. The method of claim 21 further comprising:

receiving, via said mobile terminal, an acknowledgement signal from said locating tag associated with said desired object; and indicating, via said mobile terminal, receipt of said acknowledgement signal.

23. The method of claim 22 wherein said indicating, via said mobile terminal, receipt of said acknowledgement signal, comprises providing a visual indicator on said display in said mobile terminal.

24. The method of claim 22 wherein said indicating, via said mobile terminal, receipt of said acknowledgement signal, comprises providing an audible indicator in said mobile terminal.

25. The method of claim 21 wherein a polling switch included in each of said locating tags initiates said transmitting of said polling signal from said locating tag when said polling switch is actuated by a user.

26. The method of claim 21 further comprising providing an indication to said user at said any one of said locating tags in response to said acknowledgement signal from said mobile terminal.

27. A method for locating objects using a cellular telephone, said method comprising:

displaying a listing of objects on a display in said cellular telephone, each of said objects having a locating tag associated therewith, each tag including an associated tag identifier;

selecting a desired object from said listing;

transmitting a polling signal to said locating tags, said polling signal including a tag identifier of said locating tag corresponding to said desired object; and emitting an audible signal selectively by said locating tag associated with said desired object based on said tag identifier in said polling signal.

* * * * *